United States Patent [19]

Marulic et al.

[11] 4,141,300

[45] Feb. 27, 1979

[54] RAILWAY CAR FOR HIGHWAY TRAILERS

[75] Inventors: Walter J. Marulic, Gary, Ind.; Ray L. Ferris, Thornton, Ill.

[73] Assignee: Pullman Incorporated, Chicago, Ill.

[21] Appl. No.: 806,791

[22] Filed: Jun. 15, 1977

[51] Int. Cl.[2] ..... B65J 1/22

[52] U.S. Cl. ..... 105/368 S; 105/366 R

[58] Field of Search ..... 105/368 S, 366 R, 414, 105/416

[56] References Cited

U.S. PATENT DOCUMENTS

| | | | |
|---|---|---|---|
| 3,143,978 | 8/1964 | Clejan | 105/368 S |
| 3,168,876 | 2/1965 | Clejan | 105/368 S |
| 3,268,250 | 8/1966 | Ferris | 105/368 S |
| 3,513,804 | 10/1968 | Yeates et al. | 105/368 S |
| 3,616,764 | 11/1971 | Johnson et al. | 105/366 |

*Primary Examiner*—Lawrence J. Oresky

*Attorney, Agent, or Firm*—Thomas G. Anderson

[57] ABSTRACT

A railway car for carrying highway trailers includes an intermediate frame section having a platform for supporting trailer hitches adapted for crane loading operations. The outer ends of the frame are connected to stub sills which include wheel supporting depressed treadways. The associated bolster and bearer structure with the intermediate frame section provides a lightweight trailer hauling car of high strength construction.

12 Claims, 7 Drawing Figures

RAILWAY CAR FOR HIGHWAY TRAILERS

BACKGROUND OF THE INVENTION

Field of the Invention

The present invention relates to railway cars and particularly a lightweight high strength car for supporting two trailers connected to trailer hitches.

SUMMARY OF THE INVENTION

The present invention is primarily concerned with a lightweight car of light construction for carrying two highway trailers. The car includes an intermediate section comprising a pair of longitudinally extending laterally spaced I-beams which are interconnected by diagonal beams disposed in criss-cross configuration. The center of the frame includes a platform which supports, on opposite sides of the center line, a pair of trailer hitches particularly adapted for crane loading operations. The trailer hitches include closed gathering apertures adapted to guide the trailer king pins of the trailers into a rotatable locking jaw which is manually operated between lock and unlock positions.

The opposite ends of the intermediate frame are each connected to a stub type of center sill which overlaps and is disposed between the ends of the intermediate frame. The stub center sill is connected to the ends of the longitudinal I-beams by means of a plurality of vertically spaced shear plates providing a strong construction. Treadways for supporting the wheels of the trailers are disposed on opposite sides of the stub center sills and are reinforced by vertically extending channel type stringers in turn supported on outwardly projecting bearer members. The bolster construction includes a center plate and outwardly extending plates having a horizontal portion connected to the upper ends of the stub sills, a diagonal portion and a vertical portion which is suitably connected to the lower ends of the stub sills by means of flanged gusset members. In the area of the bolster structure the stringers are also supported by an outwardly extending flanged side bearer.

DESCRIPTION OF THE PREFERRED EMBODIMENT

Figure 1:
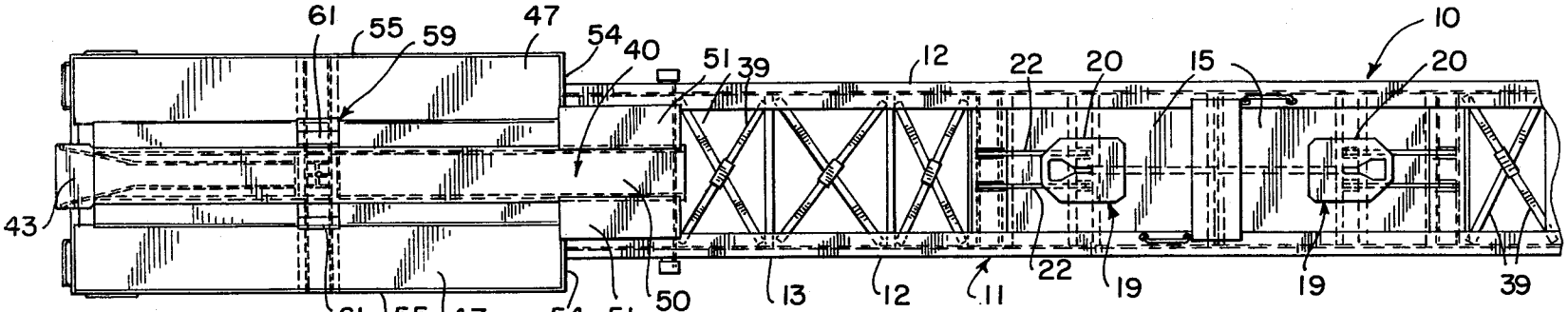
FIG. 1 is a plan view of a major portion of the railway car, both ends of the car being symmetrical.
Figure 2:
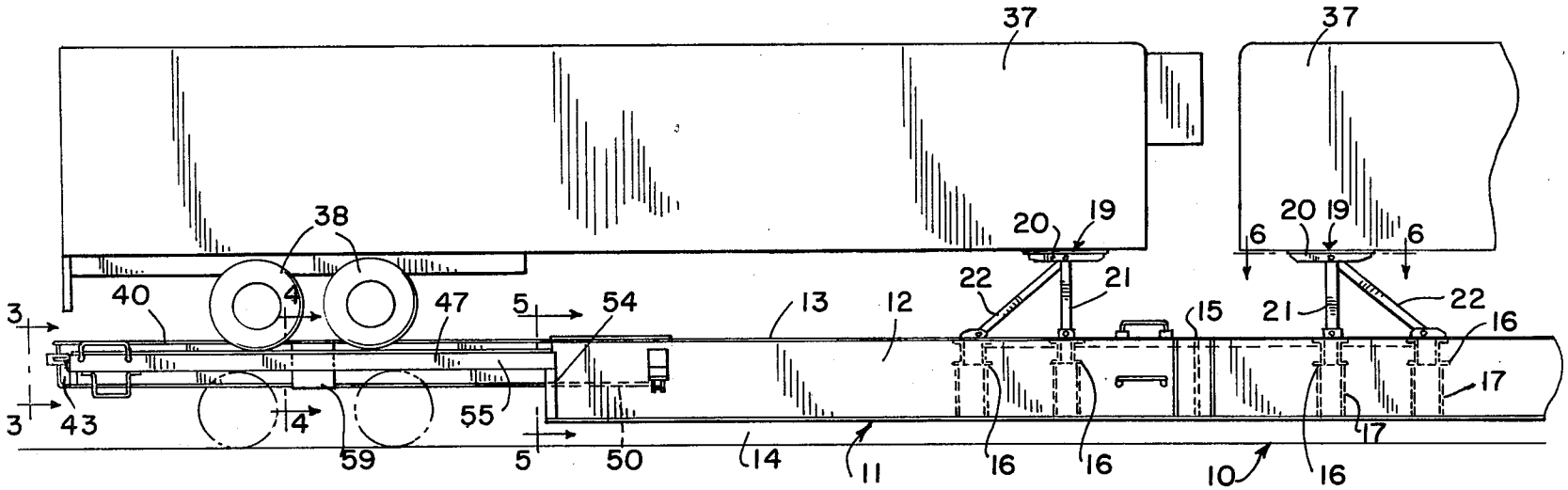
FIG. 2 is a side elevational view of the railway car shown in FIG. 1.
Figure 6:
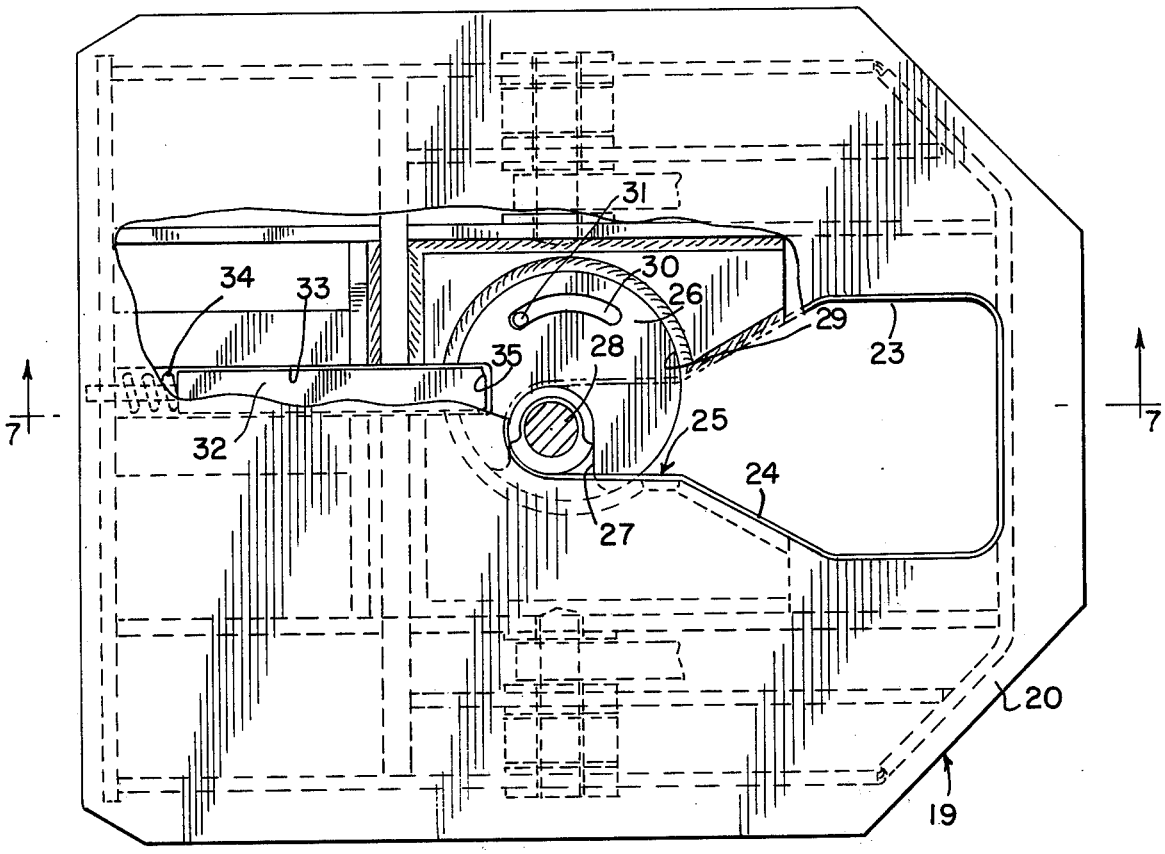
FIG. 6 is a plan view of a trailer hitch having certain portions broken away.
Figure 7:
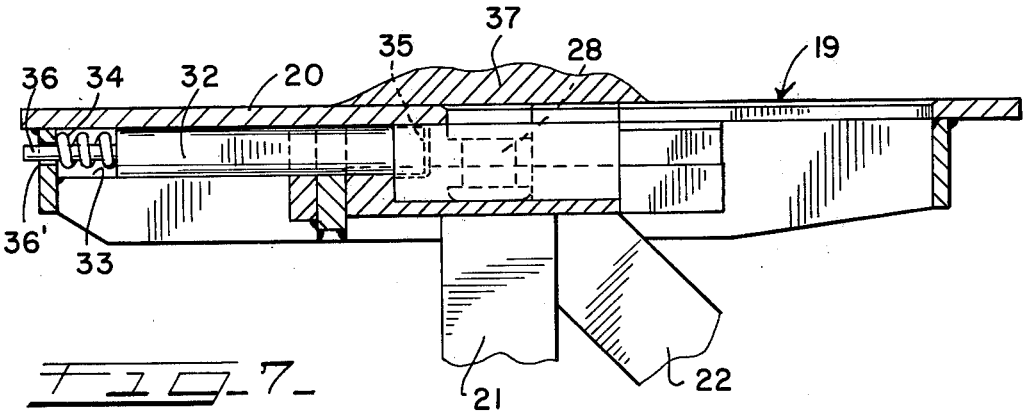
FIG. 7 is a cross-sectional view taken substantially along the line 7—7 of FIG. 6.

Referring particularly to FIGS. 1 and 2 a railway car 10 comprises an intermediate frame 11 consisting of a pair of longitudinally extending I-beams 12 having upper flanges 13 and lower flanges 14. A platform 15 is disposed on top of the intermediate frame 11 substantially centrally thereof as best indicated in FIG. 1. The car in this area includes a plurality of transversely extending channel-shaped beams 16 also suitably connected to vertically extending horizontally spaced plates 17 which interconnect the I-beams 12. The center of the car is also provided with a cross beam structure designated at 18. The cross beams 16 support trailer hitches 19. Each trailer hitch 19 comprises a top plate 20 connected to an upright leg 21 suitably connected to one of the cross beam structures 16 and also includes a diagonal leg 22 suitably connected to one of the other cross beam structures 16. The top plate as best shown in FIGS. 6 and 7 includes a closed gathering opening 23 having converging side or guide walls 24 leading into a king pin receiving slot 25 provided in the top plate 20. The top plate also supports a king pin locking disc 26 having an open slotted jaw 27 for receiving the king pin 28 of a trailer 37. The locking disc 26 is disposed in a cylindrical opening 29 of the top plate. An arcuate slot provided in the cylindrical locking disc 26 is adapted to limit the rotational movement of the locking disc 26 by its engagement with a stop 31 projecting into the slot 30 from the top plate. A locking plunger 32 is disposed in a guide way 33 within the top plate 20. The locking plunger is spring actuated by means of spring 34 whereby the end of the locking plunger is urged into engagement with a stop socket 35 provided in the outer surface of the locking disc 26. A pin or rod 36 supports the spring 34 and extends through an opening 36' provided in the top plate 20. The extension of the rod 36 indicates whether or not the locking plunger is engaged and the same is conventional in the art of trailer hitches.

Figure 5:
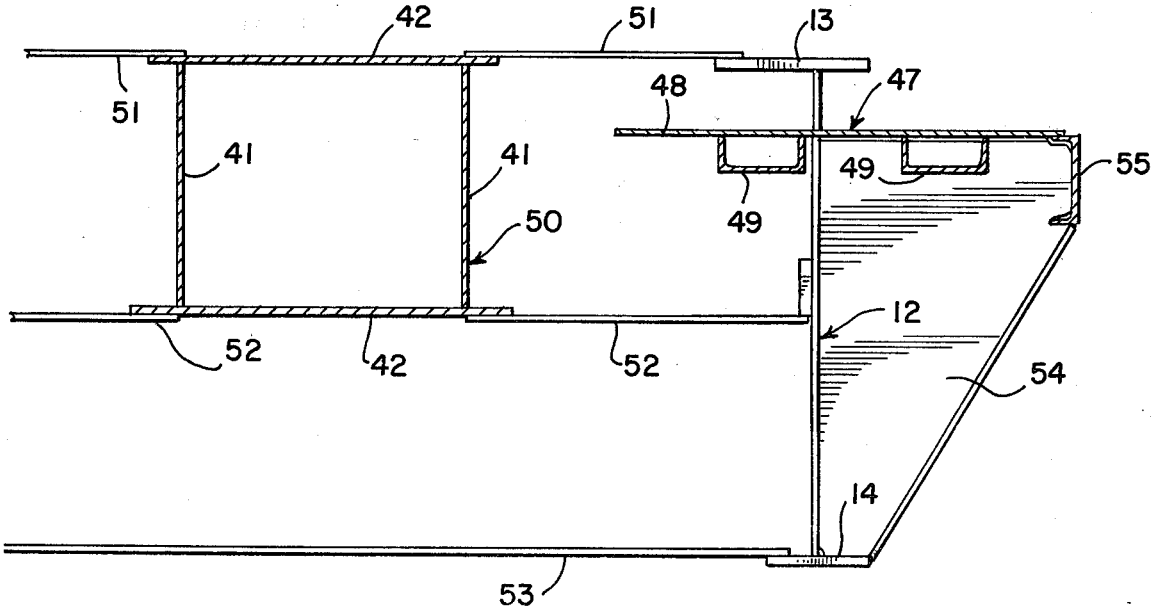
FIG. 5 is a cross-sectional view taken substantially along the line 5—5 of FIG. 2.

As best shown in FIG. 2 a pair of trailers 37 are supported on the car 10 each including a wheel suspension 38. As best shown in FIG. 1 the intermediate frame 11 is also reinforced by means of diagonally extending tension members 39 disposed in criss-cross relation. A stub center sill 40 projects outwardly from opposite ends of the intermediate frame 11. Each stub center sill includes vertical plates 41 and horizontal plates 42 suitably secured together by welding or other means. Generally the entire car is welded together though the parts may also be secured by other conventional connecting techniques. The ends of the car and stub center sill 40 include coupler housings 43 comprising spaced upright members 44 and a lower coupler support 45 disposed below a cross member 46. The usual conventional coupler may be employed or the car may have end-of-car cushioning arrangements also well known in the prior art. A pair of treadways 47 are supported on opposite sides of the stub center sills 40. Each of the treadways 47 consist of horizontal plates 48 which are supported by means of longitudinally extending stringers 49 extending substantially the length of the treadways 47. The stringers are of channel construction. The stub sill has overlapping extensions 50 which extend into and between the I-beams 12. The overlapping extensions 50 as best shown in FIG. 5 include shear plates 51 suitably connected to the flanges 13 of the I-beams 12 the shear beams 52 being connected to the stub sills and to the vertical webs 12' of the I-beams 12. Further lower shear plates 53 are connected to the lower flanges 14 of the I-beams 12. The connection of the stub sills to the I-beams provides a lightweight and yet very strong construction. A vertical flanged gusset 54 also is connected to the I-beams 12 in the overlapping region adjacent the ends of the I-beams and in turn the vertical flange gusset 54 is connected to side sills 55 and to the longitudinal stringers 49.

Figure 3:
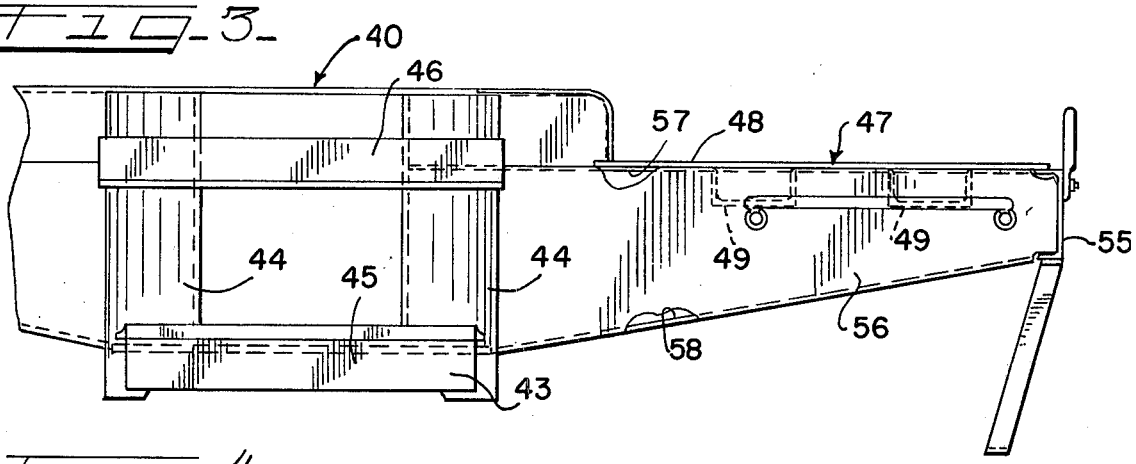
FIG. 3 is a front elevational view taken along the line 3—3 of FIG. 2.

As best shown in FIG. 3 the ends of the stub sill are connected to the side sills 55 by means of side bearers 56 having flanges 57 and 58. The ends of the stringers 49 are also connected to the side bearers 56.

Figure 4:
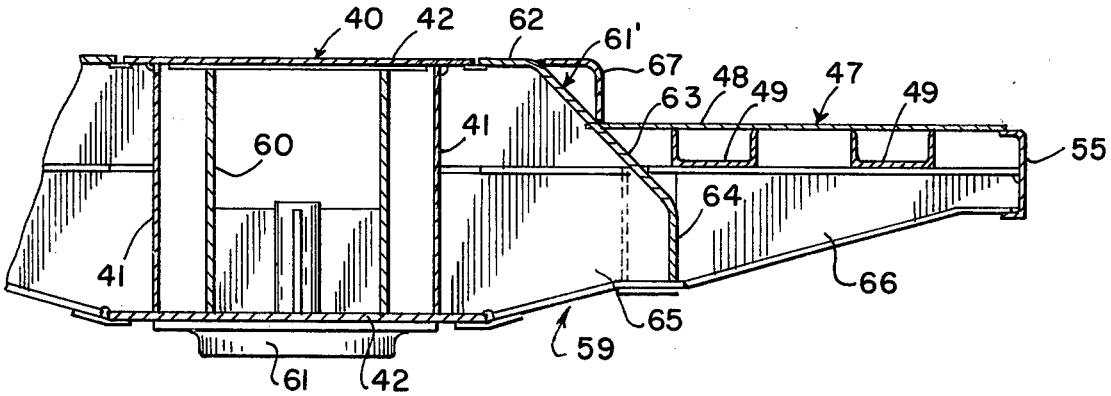
FIG. 4 is a cross-sectional view through a bolster assembly taken along the line 4—4 of FIG. 2.

As best shown in FIGS. 1 and 2 a bolster 59 is provided for each of the stub sills and includes a center filler end box construction 60 of conventional design including a center plate 61. As best shown in FIG. 4 outer support plates 61' are provided on opposite sides of the stub sill in the region of the bolster and these support plates 61' include an upper flange portion 62 suitably connected to the upper plate 42 of the plates 42 of the stub sills and a diagonally extending portion 63 having at its terminal end a vertical portion 64 which in turn is connected by means of gussets 65 to the vertical walls 41 of the stub sill. A flanged side bearer 66 is in turn connected to the plate portion 64 and to the stringers 49 and side sill 50. Each of the plates 48 of the treadway 47 extends inwardly and is suitably connected to the diagonal portion 63 of the plate structure 61'. Flanged caps 67 are also suitably connected to the treadways and to the outer support plate 61'.

The aforementioned construction provides for a lightweight car specifically adapted for hauling two trailers. A simple and strong car construction is provided by the inter-connection of the various structures of the car and the center platform 15 is ideal for crane loading of the trailers. The operator may stand on the platform 15 and will manually open the jaw of the trailer hitch by withdrawing the plunger 32 from the slot 35. Upon rotation of the jaw 27 from the closed position indicated in FIG. 6 the king pin is free and the trailer may then be lifted by crane from the car to the trailer yard for over the highway operation. By virtue of the I-beam construction of the intermediate frame with the relatively high height a car of a low center of gravity results which is ideal for the hauling of highway trailers.

What is claimed is:

1. A railway car for supporting highway vehicle means comprising:

an intermediate frame structure including a pair of longitudinally vertically extending laterally spaced main support beams, reinforcing members extending laterally and connecting said beams, a platform supported on said beams and extending outwardly from the center of said car for supporting vehicle hitch means at the center portion of the car, end structures each including a stub center sill connected to a respective opposing end of said intermediate frame, each center sill comprising a box-like structure and overlapping the intermediate frame structure in extending between said beams defining an overlapping region between each end structure and an outer end of the intermediate structure, shear means connecting each of said stub center sills with the longitudinal end portions of the beams at the overlapping region, each end structure further including a pair of longitudinally extending vehicle wheel supporting treadways each being spaced longitudinally outward of a respective intermediate structure and being disposed on a respective outer side of a respective stub sill and being positioned below the upper edges of said respective stub sill, said treadways further each having outer portions being spaced laterally outward of a respective main support beam and having underposed first laterally and vertically extending bearing means supporting same, said first bearing means being connected with and having its outer portions extending laterally outwardly of the end of the associated main support beam at the overlapping region, means reinforcing said treadways including longitudinally extending support means being connected to the underneath surfaces of said treadways, outwardly projecting bolster bearer means and end bearer means being longitudinally spaced of the car and connected to said center sills supporting said means reinforcing, and each of said end structures having longitudinally extending side sills laterally outward of the main support beams connected with the laterally outer ends of said respective bolster and end bearer means and the first bearing means.

2. The invention in accordance with claim 1, and each of said longitudinal main support beams being of I-shaped configuration and having upper and lower flanges.

3. The invention in accordance with claim 2, and said shear means having upper, intermediate, and lower shear plates for each stub sill, each stub sill having upper and lower horizontal plates each connecting respective upper and intermediate shear plates, the upper and lower shear plates connecting respectively with the upper and lower I-beam flanges and the intermediate shear plate connecting with the I-beam intermediate its flanges.

4. The invention in accordance with claim 1, said vehicle hitch means including trailer hitches each having a top plate, a vertical support leg and a diagonal leg connected to said top plate, and transversely extending beams connected to said longitudinal beams for supporting each of said legs.

5. The invention in accordance with claim 4, said top plates each having a closed gathering opening, said opening including sides converging toward a king pin receiving jaw, said jaw including a socket, and said jaw being rotatable from an open to a locked position upon receipt of a king pin.

6. The invention in accordance with claim 1, said reinforcing members connecting said beams extending diagonally in criss-cross fashion.

7. The invention in accordance with claim 1, said shear means including upper and lower shear plates connected to the upper and lower portions of said beams and said sills.

8. The invention in accordance with claim 7, said stub sills including vertically spaced horizontal plates, and horizontally spaced vertical plates connected to form a box-like structure, and said shear plates being connected to said horizontal plates.

9. The invention in accordance with claim 1, said bolster bearer means including a bolster part attached on each side of the respective stub center sill and a center plate means connected with the center sill underside between the bolster parts, each bolster part including upper and lower flange means between web means and a diagonal support plate means connecting with the bolster part and connecting with the upper part of the stub sill and the lower flange means and supporting the lateral inner edge of the associated treadway.

10. The invention in accordance with claim 9, and flange cap means connected with the treadway and the diagonal support plate means.

11. The invention in accordance with claim 1, and said treadways further each being spaced laterally inward of a respective mean support beam.

12. The invention in accordance with claim 1, and said means reinforcing including stringers.

* * * * *